United States Patent [19]

Mayer

[11] 4,444,720

[45] Apr. 24, 1984

[54] DEVICE FOR THE OUTPUT OF A DEODORIZING SUBSTANCE INTO AN AIR STREAM PARTICULARLY IN VAPOR EXHAUST HOODS IN KITCHENS

[76] Inventor: Horst Mayer, Wagenbergstr. 33, 5760 Arnsberg 1, Fed. Rep. of Germany

[21] Appl. No.: 335,842

[22] Filed: Dec. 30, 1981

[30] Foreign Application Priority Data

Jan. 8, 1981 [DE] Fed. Rep. of Germany ..... 3100320

[51] Int. Cl.[3] ..... A61L 9/04; A61L 9/12

[52] U.S. Cl. ..... 422/119; 55/DIG. 36; 98/30; 98/109; 422/4; 422/124

[58] Field of Search ..... 422/124, 4, 119; 62/78; 98/30, 109; 55/DIG. 36

[56] References Cited

U.S. PATENT DOCUMENTS

| | | | |
|---|---|---|---|
| 1,121,845 | 12/1914 | Kallusch | 422/124 |
| 1,528,640 | 3/1925 | Tvrzicky et al. | 422/124 |
| 1,567,957 | 12/1925 | Kesselman | 422/124 X |
| 2,585,339 | 2/1952 | Miller | 422/124 |
| 2,614,820 | 10/1952 | Boydjieff | 422/4 X |
| 2,937,419 | 5/1960 | Vaughn | 422/119 |
| 3,442,602 | 5/1969 | Diehl | 422/4 |
| 3,661,323 | 5/1972 | Farris | 98/30 X |
| 3,898,922 | 8/1975 | Savage . | |
| 3,930,797 | 1/1976 | Gertz | 422/124 |
| 4,036,994 | 7/1977 | Ear . | |

FOREIGN PATENT DOCUMENTS

| | | | |
|---|---|---|---|
| 8387 | 3/1980 | European Pat. Off. | 422/4 |
| 592459 | 1/1934 | Fed. Rep. of Germany . | |
| 2370237 | 6/1978 | France | 55/DIG. 36 |

*Primary Examiner*—Barry S. Richman

*Attorney, Agent, or Firm*—Toren, McGeady and Stanger

[57] ABSTRACT

In a device for releasing an odor-destroying substance into an air stream, such as for use with a kitchen exhaust hood, a refillable reservoir has an open side covered by a hood-shaped wall with flow openings through the wall. A cover disk extends over the hood-shaped wall on the opposite side from the reservoir for adjusting the flow openings, the hood-shaped wall affords a forced guidance of at least a part of the air stream past the open side of the reservoir.

1 Claim, 2 Drawing Figures

DEVICE FOR THE OUTPUT OF A DEODORIZING SUBSTANCE INTO AN AIR STREAM PARTICULARLY IN VAPOR EXHAUST HOODS IN KITCHENS

SUMMARY OF THE INVENTION

The invention refers to a device for the release of an odor-destroying substance into an air stream, in particular for kitchen vapor exhaust hoods.

Vapor exhaust hoods, in particular kitchen vapor exhaust hoods, are nowadays equipped as a rule, for odor destruction with an active carbon filter which is positioned in front of the suction grid of the suction blower. Disadvantages experienced in the use of active carbon filters are, for one thing, they greatly increase the flow resistance of the entire exhaust hood, leading to an oversize suction blower, and, for another, the mechanism of action of such filters is controversial. Further the oversize suction blower leads to additional noise pollution of the environment, and moreover, the degree of saturation or respectively the controlled monitoring of the filter action is not possible with active carbon filters.

It is the object of the invention to provide a device by which an odor-destroying substance can be introduced into an air stream, in particular into the suction stream in kitchen vapor exhaust hoods. Refillability of the odor-destroying substance is ensured, just as the reduction of the flow resistance is kept to a minimum, to be able to employ smaller blowers.

This problem is solved in a device of the above named kind, according to the invention, by a reservoir for the odor-destroying substance open downstream relative to an air stream generated by a blower, and by guide elements for the forced conduction of at least a part of the air stream past the open region of the reservoir.

Providing a reservoir inside the air stream has the advantage that it can be designed so that solely by the sweeping of the air sucked in and laden with the undesired odors an odor-destroying or odor-reducing substance can be introduced into the air stream without requiring the high outputs of the suction blowers as needed in prior art. These odor-destroying substances may be, e.g. solid particles, gases, and in particular liquids.

If liquids are employed, the invention provides that the reservoir is designed as a vessel open on one side and containing a liquid-absorbing filling, while the guide elements are designed as a wall with flow-through openings covering the vessel in spaced relation and in hood-like fashion. It has been found to be particular expedient if the vessel is designed as an open annular trough with a felt filling which is covered concentrically by the hood type wall in spaced relation, whereby on the one hand a comparatively large reservoir is made available, and on the other hand, due to the trough form the possibility is given to provide by-pass flow-through openings which greatly reduce the flow resistance of the entire device. The hood type wall then forms the guide element for the air streams and may, depending on requirements, be constructed in the form of nozzles or the like, to obtain the necessary flow velocities past the reservoir.

In a particular embodiment of the invention that the hood type wall is designed as a flat plate with edges directed upstream and with openings in the flat plate arranged segmentwise, which openings can be selectively opened and closed by a cover disk concentric therewith. By this configuration it is possible with simple means to obtain a very accurate proportioning of the odor-destroying substance within the air stream. Thus, by appropriate opening or closing of the openings by the cover disk, the air stream through the device can be increased or reduced, leading to an economical use of the liquid odor-destroying substance.

A structurally simple solution consists, according to the invention, in that the vessel and the hood type wall can be attached concentrically to a common fastening element within an air stream channel, and advantageously it may be provided also that a suction gap tapering inwardly downstream is formed between the vessel and the hood type wall.

In principle, the elements of the device in particular the adjustment of the suction openings, and hence the quantity of air stream sweeping past the reservoir, can be regulated and controlled automatically. It may, however, be expedient to let the housewife do this herself. To this end, the invention provides, in a very simple design that the attachment is arranged concentrically at the suction grid of the vent of a kitchen vapor exhaust hood, with the cover disk controlling the segmentwise arranged openings in the hood type wall partially traversing the housing wall of the discharge hood for the selective adjustment of the flow cross-section.

The invention provides for easy refilling the device with liquid odor-destroying substances in that the cover disk has a filling opening for filling liquid odor-destroying material into the felt filling of the vessel, which filling opening corresponds in at least one position to a corresponding filling opening in the hood type wall for refilling. Additionally, the vessel may be provided with a device for the level indication of the odor-destroying substance. This regulation or display of the level may occur by moisture sensors or by weight differences between the filled and empty reservoir.

For the level detection using weight differences, the device may be provided, according to the invention so that the reservoir is suspended by a spring in such a way that when an insufficient filling level exists, electric contacts close via a spring action, which contacts in the filled state are held in the open position by the weight of the odor-destroying substance.

Further advantages, features and details of the invention will be evident from the following description and with reference to the drawing.

The device marked generally by 1 is fastened to the suction grid 3 of a suction blower not illustrated more specifically, inside a vapor exhaust hood 2 shown only schematically. The attachment is arranged so that there remains an adjustable space 5 between a cover disk 4, described more specifically below, and the suction grid 3.

Figure 1:
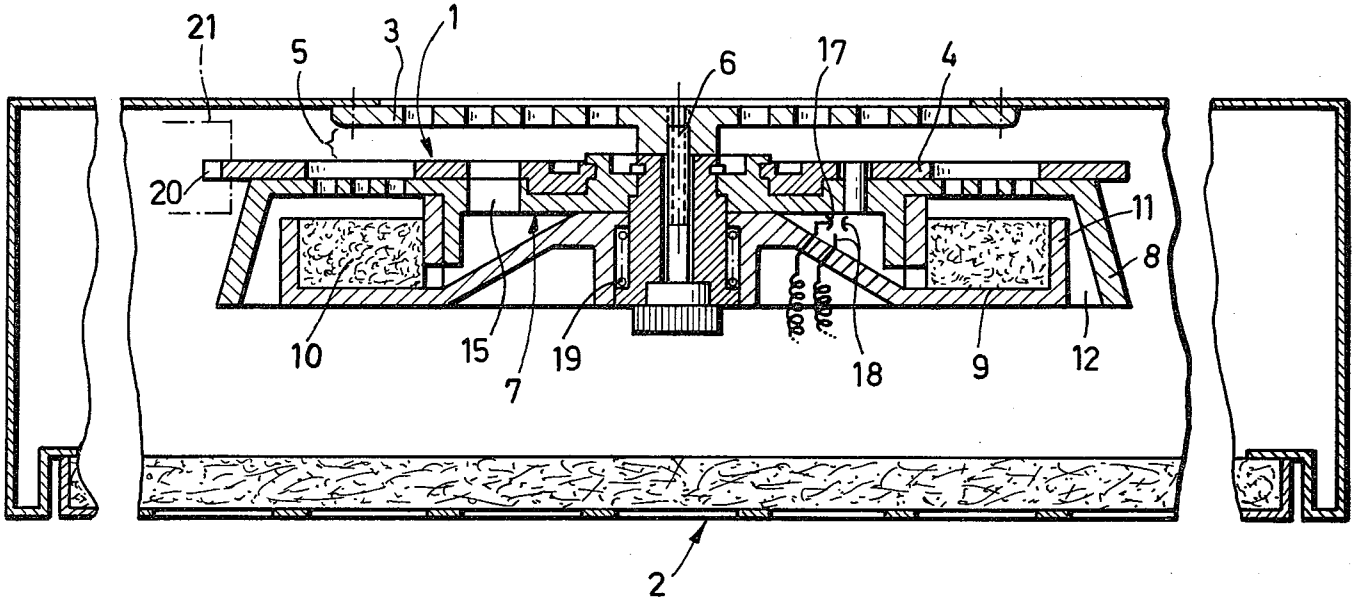
FIG. 1, a simplified drawing in section through the device of the invention, ready for installation inside a schematically illustrated vapor exhaust hood, and in FIG. 2, a top view onto a part of the device shown in FIG. 1.

As viewed in FIG. 1 the top is downstream and the bottom is upstream.

The device 1 consists essentially of a hood type wall 7 arranged concentrically around a central axis 6 and designed as a flat plate, having an edge 8 directed upstream which laterally and concentrically encloses an interior reservoir 9. The reservoir 9 is designed as a circular trough open in the downstream direction with a felt filling 10 and is fastened centrically to about the central axis 6 for axial displacement on the axis.

Figure 2:
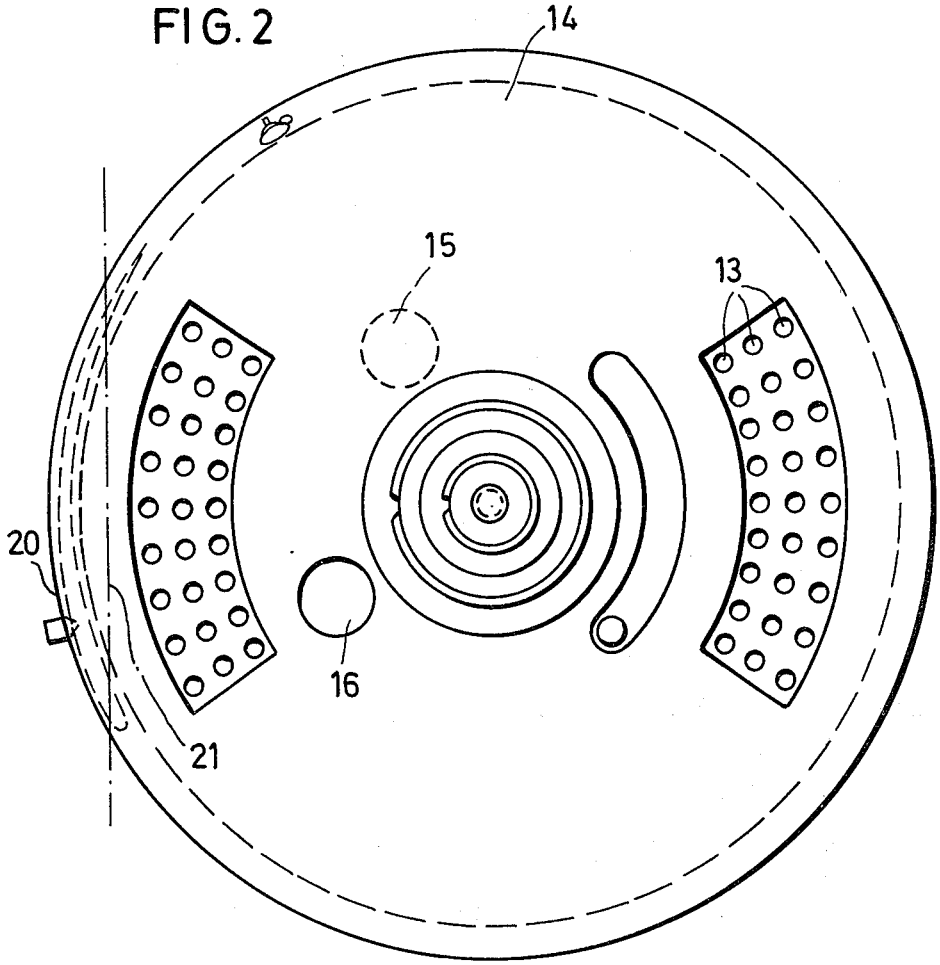

As is evident from FIG. 1, the radially outer wall 11 of reservoir 9, relative to the axis 6, forms with edge 8 of the hood-shaped plate type cover wall 7 an annular flow channel 12 tapering inwardly in the downstream direction. The covering wall 7 is equipped with segments, as can be seen from FIG. 2, preferably 60° segments, with openings 13. Corresponding segments, marked 14 in FIG. 2, in the cover 4 disk extending over the covering wall 7 so that the segments with the openings 13 can be closed partially or totally. In FIG. 2 it can be seen also that the hood-shaped plate type wall 7 is equipped with a filling opening 15 for filling a liquid odor-destroying substance into the reservoir 9, the cover plate 4 is equipped with at least one corresponding opening. 16, for example in FIG. 2 where the segments with openings 13 are in the open position and the opening 16 is spaced from the corresponding opening 15 of a segment section left free, which in FIG. 2 is marked 16.

As example of a filling level indication by gravity, there are shown in FIG. 1 two electric contacts 17 and 18, which are held spaced from each other by the weight of the reservoir 9 filled with the odor-destroying liquid. Acting counter to gravity is a spring 19 which biases the reservoir 9 in the direction of contact 17. As the odor-destroying liquid is gradually used up, the weight of reservoir 9 decreases, whereby spring 19 is able to raise the reservoir. If the odor-destroying liquid drops below a certain level, contact 18 comes in contact with contact 17 and closes a circuit which, for example through a visual or acoustical indication, signals the user of the device that the level of the liquid has been fallen short of the certain level, so that refilling is necessary.

For adjusting the flow opening 13 or, respectively, for the selective covering the flow openings by the cover disk 4, the disk is made larger in diameter than the largest diameter of the remainder of the device 1 by a radially outer partial region 20 traversing the housing, marked 21 in FIG. 2, of the vapor exhaust hood 2. By corresponding marks on the edge region of the cover disk 4 the state of adjustment of the device 1 can be observed from the outside by the user.

Naturally the described embodiment can be modified in many respects without departing from the basic idea of the invention. Thus the invention is not limited in particular to a special form of the reservoir and an arrangement inside the device. In particular an impregnable felt disk or the like of larger area may be provided. Also single vessels in star arrangement may be arranged below a common hood, the correlation of which to the air stream is variable. Also the invention is not limited to a special filling level indication. Besides the described gravity electric-contact-controlled level indication, sensor elements may be provided which react to moisture, to organic substances or e.g. to the negative heat of evaporation resulting upon evaporation, or the like.

I claim:

1. In a device for the release of an odor-destroying substance into an air stream, such as for kitchen vapor exhaust hoods, comprising a vapor exhaust hood having a vapor inlet side and a vapor outlet side, a suction grid located in the vapor outlet side of said vapor exhaust hood, wall means for forming a reservoir for an odor-destroying substance located within said vapor exhaust hood in the path of air flowing from the vapor inlet side to the vapor outlet side of said hood, said reservoir being open on the side thereof facing toward the vapor outlet side of said hood, wherein the improvement comprises means forming a support for said reservoir and defining a central axis extending generally perpendicularly of said suction grid for supporting said reservoir within said hood, said wall means comprises an annular trough forming the reservoir and encircling said central axis and having an open side facing toward said vapor outlet side and being closed on the side facing said vapor inlet side, said annular trough having a closed wall defining the radially outer boundary thereof, a felt filling located within said trough for receiving the odor-destroying substance, a hood-shaped wall extending over the open side of said annular trough and including a flat plate extending generally parallel to and spaced from said suction grid within said hood, and an annular edge extending from said flat plate toward said vapor inlet side and spaced radially outwardly from said closed wall of said annular trough forming in combination with said closed wall an annular flow channel so that air can flow from the vapor inlet side of said hood over the open side of said annular trough, said flat plate having flow openings therethrough located opposite said annular trough, a cover disk in contact with the side of said flat plate closer to said suction grid and being concentric relative to said central axis, said cover disk having openings therethrough and being movable about said central axis relative to said flat plate for selectively opening and closing the flow openings in said flat plate, said cover disk being adjustably spaced from said suction grid and forming in combination with said suction grid an adjustable space therebetween whereby air flowing over the open side of said trough passes through the flow openings in said flat plate and the openings in said cover disk into the adjustable space and then through said suction grid, means located within said wall means for providing an indication of the level of the odor-destroying substance within said annular trough, said means for indicating the level includes electric switching contacts disposed in spaced apart relation when the odor-destroying substance within said annular trough is above a certain level, said annular trough containing the odor-destroying substance is arranged to act in the direction of gravity based on the amount of odor-destroying substance located within said trough, and a spring located within said wall means and acting against the force of gravity for effecting the closing of said electric switching contacts when the odor-destroying substance within said annular trough falls below a certain level, said cover disk has a filling opening therein for filling odor-destroying substance into said felt filling in said annular trough, and said flat plate has a corresponding filling opening therethrough and said filling opening in said cover disk is movable into and out of alignment with said filling opening in said flat plate.

* * * * *